US005853099A

United States Patent [19]

Lessard

[11] Patent Number: 5,853,099

[45] Date of Patent: Dec. 29, 1998

[54] FIVE-PIECE OPEN CONTAINER WITH LOCKING ARRANGEMENT

[75] Inventor: Claude Lessard, Sainte-Foy, Canada

[73] Assignee: IPL Inc., St-Damien-de-Bellechasse, Canada

[21] Appl. No.: 837,893

[22] Filed: Apr. 22, 1997

[51] Int. Cl.[6] ..... B65D 6/18

[52] U.S. Cl. ..... 220/7

[58] Field of Search ..... 220/7, 6, 1.5, 4.28, 220/4.33, 326, 690, 691

[56] References Cited

U.S. PATENT DOCUMENTS

| | | | |
|---|---|---|---|
| 4,715,508 | 12/1987 | Schurch | 220/7 |
| 4,960,223 | 10/1990 | Chiang et al. | 220/7 |
| 5,515,987 | 5/1996 | Jacques et al. | 220/7 |
| 5,632,392 | 5/1997 | Oh | 220/7 |

*Primary Examiner*—Stephen J. Castellano
*Attorney, Agent, or Firm*—Joseph W. Molasky & Associates

[57] ABSTRACT

A five-piece open container comprises a bottom piece formed of plastics material and four side pieces also formed of plastics material and pivotally mounted to the bottom piece so that the side pieces may be pivotally moved between an erected position and a non-erected position. In the upper corner of each piece are provided parts which are integral with the side pieces and which enable the side pieces to be maintained in an erected inter-engagement. One of the integral parts ensures a securing arrangement when the side pieces are in the erected position, but it may be manually flexed outwardly from inside the container to enable the disengagement of the side pieces from one another so that they may be moved into a non-erected position.

8 Claims, 5 Drawing Sheets

FIVE-PIECE OPEN CONTAINER WITH LOCKING ARRANGEMENT

FIELD OF THE INVENTION

The present invention pertains to a five-piece open container formed of a bottom piece and of four side pieces and provided with a locking arrangement that secures the side pieces in their erected position.

BACKGROUND OF THE INVENTION

Containers for carrying items, such as bottles, fruits and vegetables and the like are made of injection molded plastics material to replace containers which were previously made from wood or cardboard. These plastic containers can be cleaned and washed so that they may be reused frequently.

Recently, plastic containers have been made without the use of any metallic parts so that the connection of the side pieces to the bottom piece is accomplished by integral parts of these pieces, such as hinges and hinge connections, which allow the side pieces to be folded between an erected position, an inwardly folded position and/or an outwardly folded position. One such construction can be found described in applicant's U.S. Pat. No. 5,515,987 issued May 14, 1996. Similar containers may also be found described in applicant's co-pending applications Ser. Nos. 08/696,241 and 08/696,242, both filed Aug. 13, 1996.

The above containers described in these patent and patent applications include, in the opposite lateral edges of their side pieces, complementary engaging means allowing the side pieces to be maintained in an erected position.

It has been found that these types of side engagement are not reliable and the side pieces often disengage when they are subject to harsh manipulation, especially when the containers are fully loaded.

OBJECTS AND STATEMENT OF THE INVENTION

It is an object of the present invention to provide a securing arrangement between the side pieces of a five-piece container to enhance the inter-engagement of the side pieces.

This is achieved by providing, in addition to the inter-engaging parts, as an integral part of two of the side pieces, a flexible finger actuatable part which, with the side pieces in their erected position, ensures a secured assembly of the side pieces together. On the other hand, this actuatable part can easily be moved out of this securing position allowing inward or outward pivotal movement of the side pieces, either folded over the bottom piece or lying completely outwardly for transport.

The present invention therefore relates to a five-piece open container for carrying items comprising: a rectangular bottom piece formed of plastics material, the bottom piece having opposite edges; and four side pieces formed of plastics material, each side piece having a lower edge hingedly connected to a corresponding edge of the bottom piece whereby the four side pieces may be pivotally moved between two positions including an erected position and a non-erected position. Each side pieces has, in the upper part thereof and adjacent a lateral edge thereof, cooperating means for inter-engaging the side pieces in the erected position, and finger actuatable means integral with two of the side pieces securing the side pieces in an erected inter-engagement. The finger actuatable means are flexible outwardly so as to be moved out of a securing position and to enable disengagement of the side pieces from one another.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
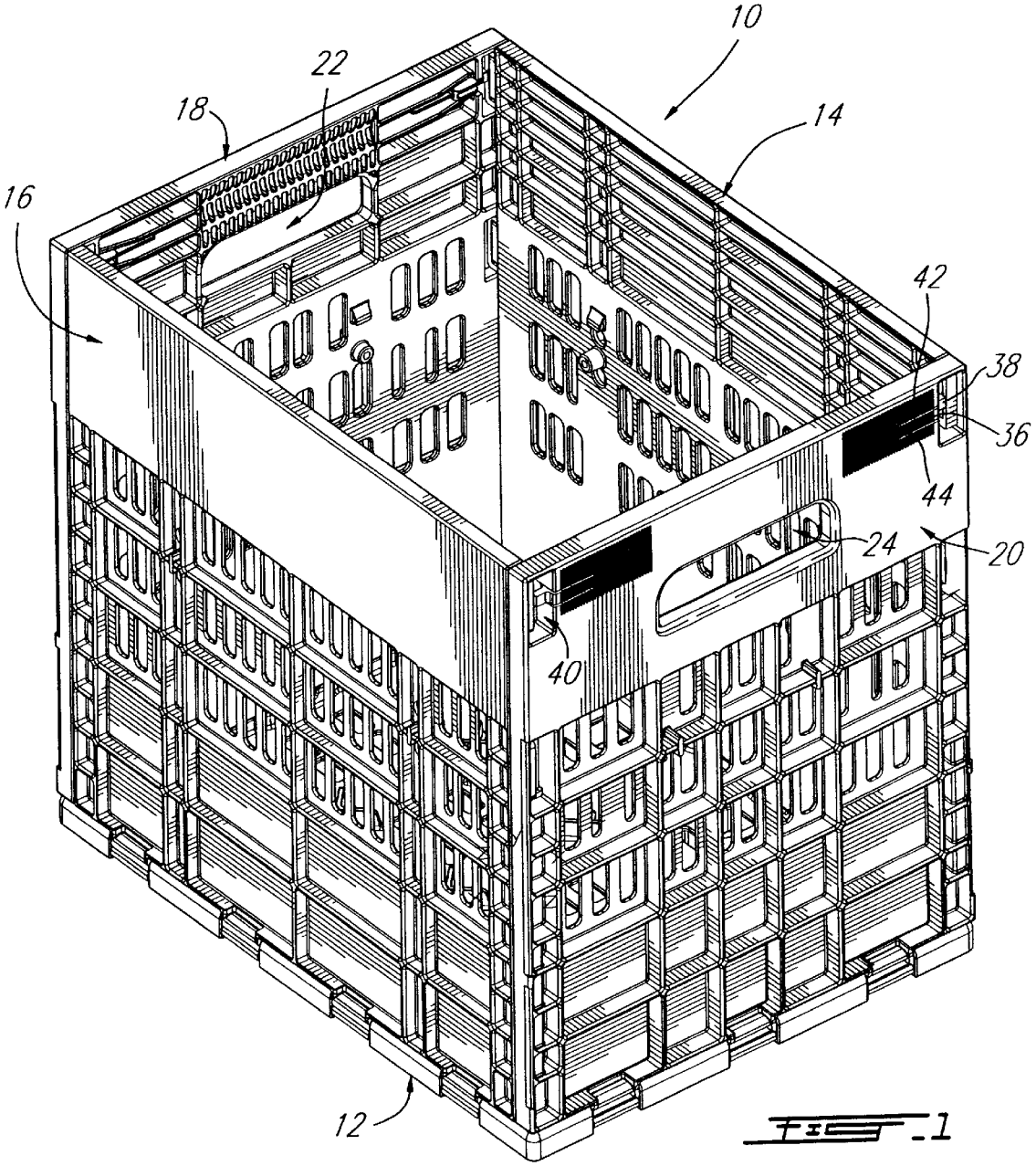
FIG. 1 is a perspective top view of a five-piece open container embodying the present invention.

Referring to FIG. 1, there is shown a five-piece open container, generally denoted 10, made entirely and solely of rigid plastics material. The container which may be used to carry bottles for example, essentially consists of a bottom piece 12, opposite side pieces 14 and 16 and opposite end pieces 18 and 20. Openings 22 and 24 are provided in the respective end pieces 18 and 20 to facilitate the manual handling of the container. The structural appearance of the five pieces of the container is conventional, consisting of reinforcing ribs and a plurality of openings to provide rigidity and lightness (and aeration in some cases).

The side and end pieces are hingedly connected to the bottom piece along their lower edge thereof. A detailed construction of the connection of the lower edges of the side and end pieces to the side and end edges of the bottom piece will not be described as it does not form part of the present invention; however, reference may be made to applicant's earlier U.S. patent application Ser. No. 08/696,242 filed Aug. 13, 1996, which is incorporated herein. The advantage of such construction is that no metallic parts are used in the connections of the side and end pieces to the bottom piece.

The present invention is particularly concerned with the connection of the side and end pieces to one another in their erected position. At each upper corner of the container, there are provided interengaging means cooperating to lockingly assemble the side and end pieces in the erected position as well as finger actuatable means to secure the side is and end pieces in this inter-engagement. As can be seen in FIG. 1, these means are provided at each corner; however, referring to FIG. 2, they will be described in detail in connection with only one corner i.e. between side piece 14 and end piece 18. It is to be noted, however, that identical means are provided in the other three corners of the container.

Figure 2:
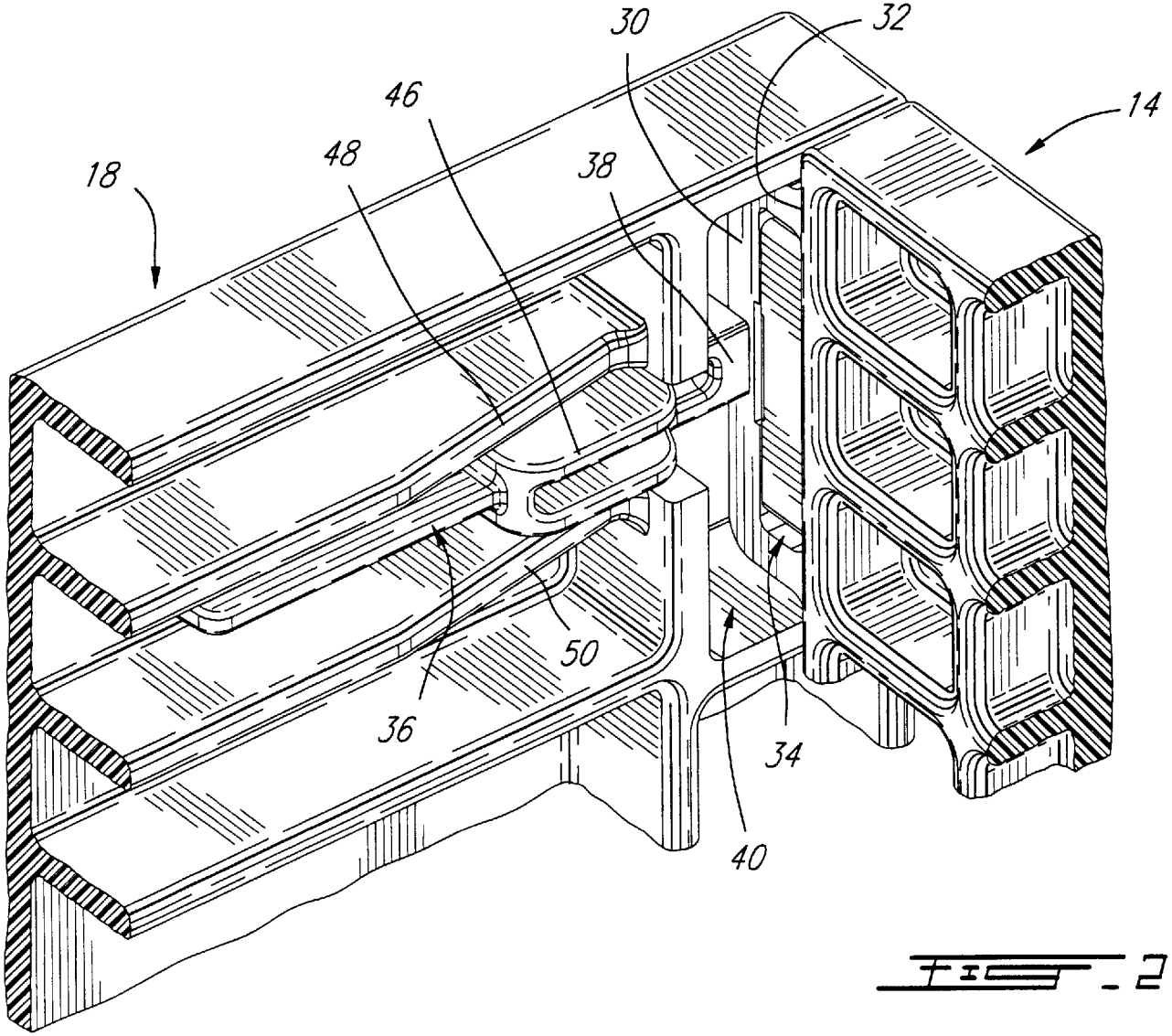
FIG. 2 is an enlarged fragmentary perspective view showing one corner of the container of FIG. 1.

Hence, referring to FIG. 2, the inter-engaging means first consist of an outwardly projecting part 30 that extends from the lateral edge 32 of the side piece 14. This projecting part 30 has a rectangular configuration with a rectangular opening 34.

The end piece 18 displays an elongated integral part 36 which, as can be seen in FIG. 1, has one end continuous with the side wall of the end piece and an opposite free end 38 which extends into a rectangular cavity 40 in the upper corner of the end piece. The elongated member 36 is formed as a result of the two horizontal slits 42 and 44 in the wall of the end piece so that it may be flexed outwardly relative to this side wall of the end piece. The inner side of this elongated member 36 has a finger contacting portion 46 which, by reason of the recessed portions 48 and 50 of the internal rib configuration of the end piece, can be manually moved a certain distance towards the outer wall of the end piece. In so doing, the extremity 38 of the member 36, which faces the projecting part 30 of the side piece 14, is moved away from its facing arrangement as described further hereinbelow.

Figure 3A:
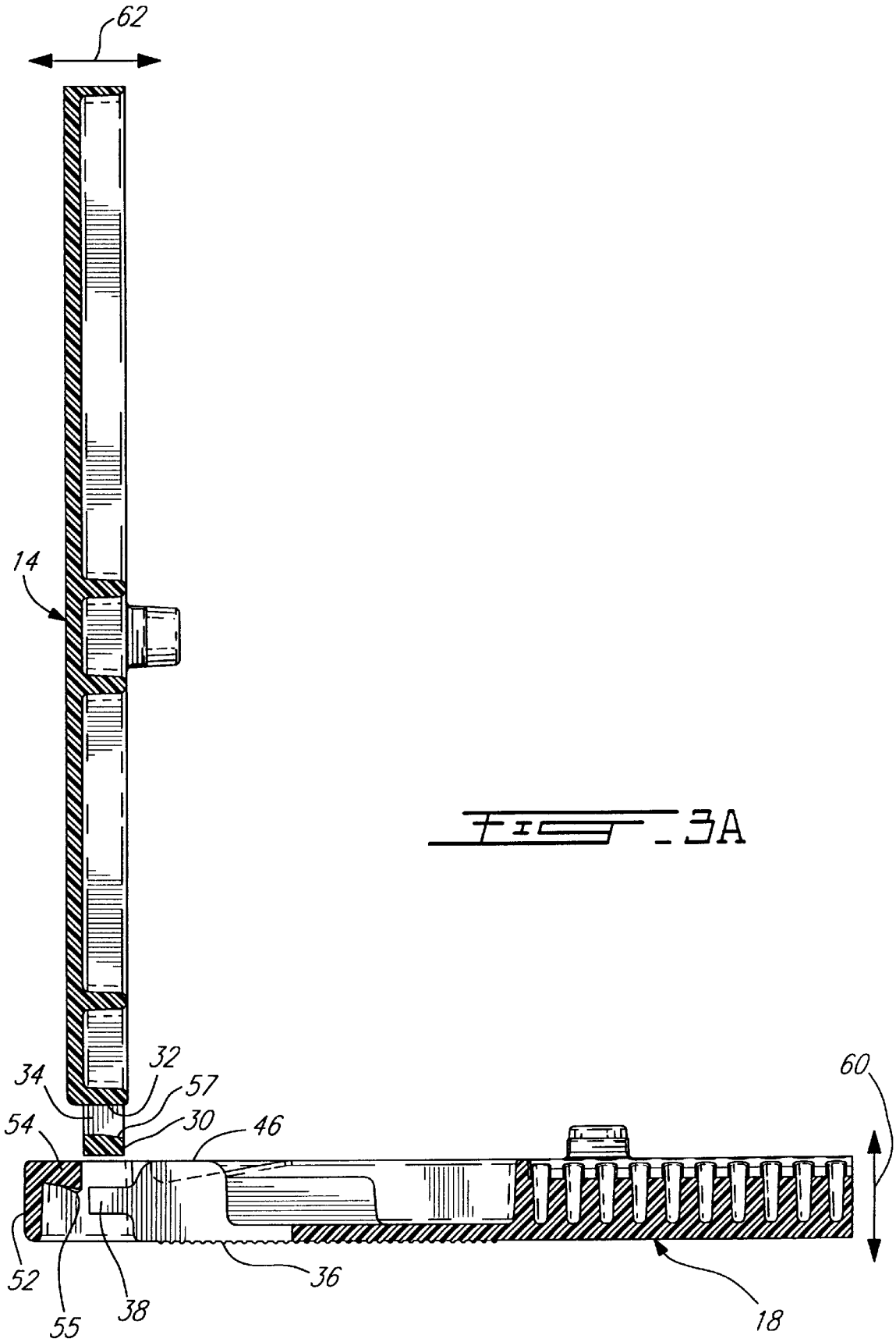
FIGS. 3*a*, 3*b* and 3*c* show the successive operations to be performed in order to secure two side pieces together.
Figure 3B:
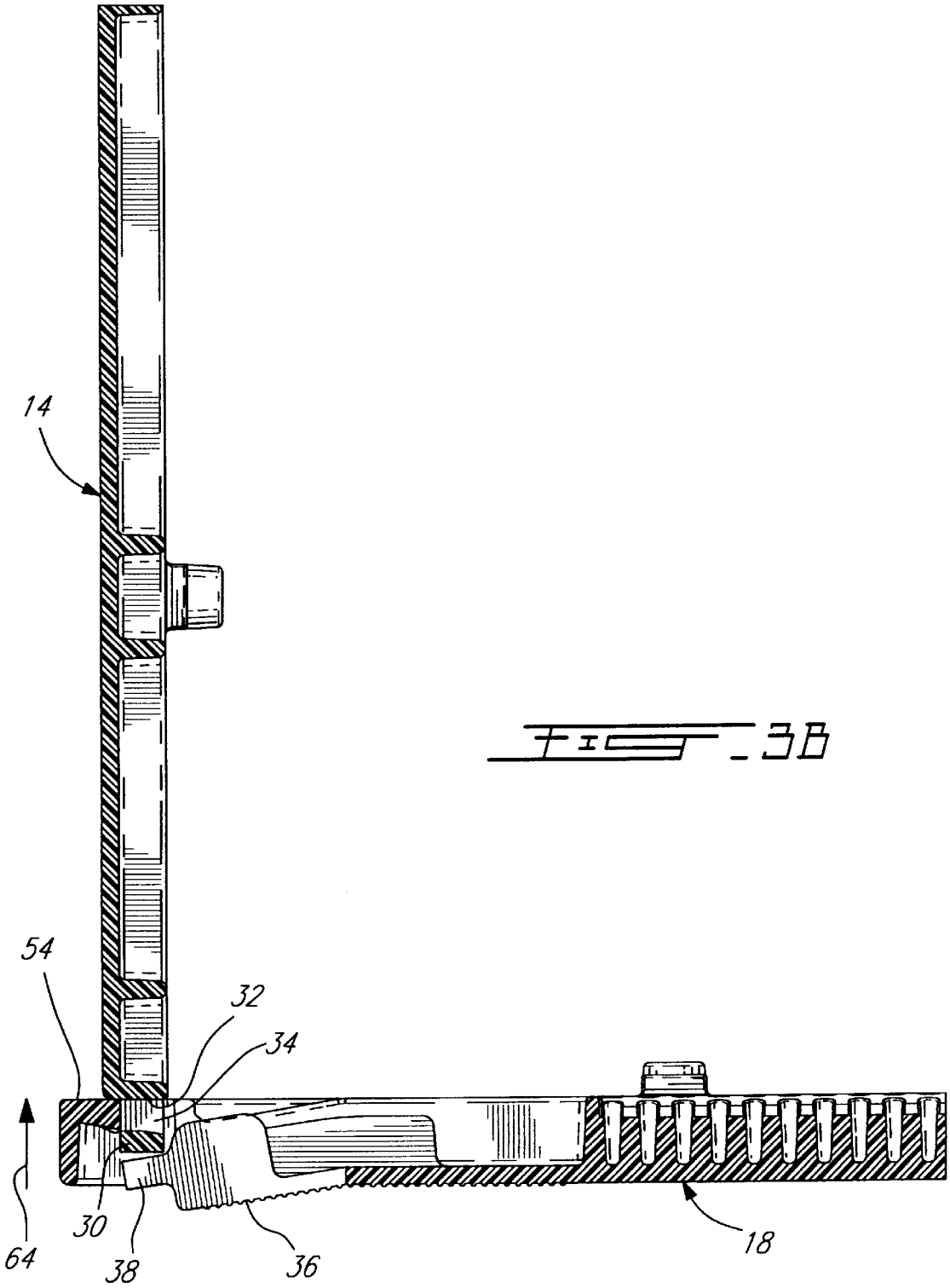
Figure 3C:
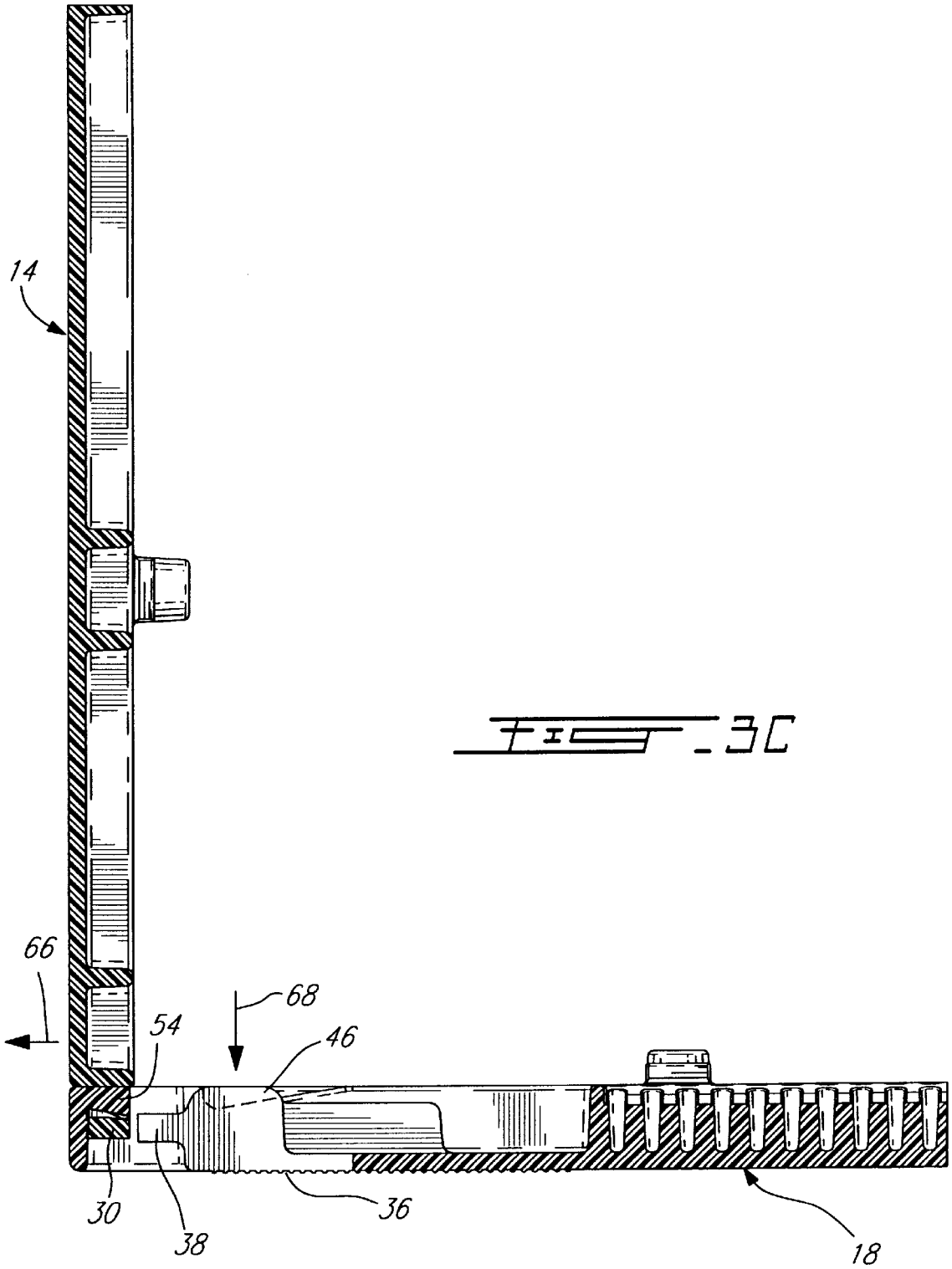

Referring to FIGS. 3*a*, 3*b* and 3*c*, the cooperating inter-engaging means consist of a second projecting part 54 which is integrally formed at the lateral edge 52 of the end piece 18; this part 54 has a configuration and a dimension so as to be fittingly received in the rectangular opening 34 of the adjacent side piece 14. Projecting part 54 has a larger rounded entry portion 55, the function of which will be described further hereinbelow.

With reference to FIGS. 3*a*, 3*b* and 3*c*, the assembly of the side and end pieces in an erected position will now be described. As illustrated in FIG. 3*a*, the end piece 18 is adapted to be pivotally moved in the direction indicated by arrow 60 while the side piece 14 is adapted to be pivotally moved in the direction indicated by arrow 62.

FIG. 3*a* shows the position of the side piece 14 and the end piece 18 prior to engagement. The projecting part 30 of the side piece 14 is brought in alignment with the projecting part 38 of member 36. Thereafter, referring to FIG. 3*b*, by moving the end piece 18 in the direction indicated by arrow 64, the projecting part 30 of the end piece 14 contacts the projecting part 38 of the finger actuatable element 36 causing it to be flexed outwardly until the projecting part 54 contacts the lateral edge 32 of the side piece 14. With reference to FIG. 3*c*, the side piece 14 is then moved in the direction indicated by arrow 66 whereby the projecting part 54 is forcibly engaged in the opening 34 and the finger actuatable means 36 return to its original position, facing the first projecting part 30 of the inter-engaging means. Thus, the extremity 38 of these means secure the inter-engagement of these parts as a result of its facing arrangement. The securing engagement is enhanced by the squeezing engagement of the edge 55 against the slightly sloping entry edge 57 (see FIG. 3*a*). The resiliency in the material of the finger actuatable element 36 causes the movement of return from the position shown in FIG. 3*b* to the position shown in FIG. 3*c* without any manual assistance.

To disassemble this secured engagement, finger pressure is applied as indicated by arrow 68 on portion 46 of the flexible element 36 returning to the configuration shown in FIG. 3*b*. Thereafter, the side piece 14 is moved in the direction opposite to the direction of arrow 66, edge 54 forcingly sliding away from the sloping edge 57. Thereafter, the end piece 18 is pivotally moved in a direction opposite to that indicated by arrow 64 to adopt the position shown in FIG. 3*a* whereby the end and side pieces may be folded inwardly or outwardly, depending on the particular construction of the container.

The present invention has been illustrated with reference to the container construction shown in FIG. 1 which is a container where the side end pieces can be moved only in two positions i.e. erected position and outwardly folded position. However, the particular securing arrangement of the present invention at the upper part of each side and end pieces may also be mounted on containers having hinge connections which enable the side pieces to be folded either inwardly, or both inwardly and outwardly.

Although the invention has been described above with respect with one specific form, it will be evident to a person skilled in the art that it may be modified and refined in various ways. It is therefore wished to have it understood that the present invention should not be limited in scope, except by the terms of the following claims.

I claim:

1. A five-piece open container for carrying items comprising: a rectangular bottom piece formed of plastics material, said bottom piece having opposite edges; and four side pieces formed of plastics material, each side piece having a lower edge hingedly connected to a corresponding edge of said bottom piece whereby the four side pieces may be pivotally moved between two positions including an erected position and a non-erected position; each said side pieces having, in the upper part thereof and adjacent a lateral edge thereof, cooperating means for interengaging said side pieces in said erected position, and finger actuatable means integral with two of said side pieces securing said side pieces in an erected inter-engagement; said finger actuatable means consisting of an elongated part formed in said one of said side or end piece; and elongated part having one end facing a projecting part of said inter-engaging means; said finger actuatable means being flexible outwardly outside the plane of said one of said side or end piece so as to be moved out of a securing position and to enable disengagement of said side pieces from one another.

2. A five-piece container as defined in claim 1, wherein said cooperating inter-engaging means consist of a first part integral with one side piece, said first part having a receiving aperture therein; said cooperating interengaging means consisting of a second part integral with an adjacent side piece and projecting from a lateral edge thereof; said second part having a portion adapted to be engaged in said aperture in said securing position.

3. A five-piece container as defined in claim 2, wherein said elongated part of said finger actuatable means has one end facing said projecting part of said adjacent side piece to define said securing position.

4. A five-piece container as defined in claim 1, wherein said finger actuatable means has a finger contacting portion which is reachable inside the container so as to be moved outwardly of said plane.

5. A five-piece open container for carrying items comprising: a rectangular bottom piece formed of plastic material, said bottom piece having a pair of opposite side edges and a pair of opposite end edges; a pair of side pieces formed of plastics material, each side piece having a lower edge and a pair of opposite lateral edges; and a pair of end pieces formed of plastics material, each end piece having a lower edge and a pair of lateral edges; each said side edge and each said end edge of said bottom piece displaying a series of horizontally spaced recessed areas and a horizontally extending integrally formed hinge traversing each said recessed area; each said lower edge of said side and end pieces including a series of horizontally spaced extensions; said extensions being so disposed along each said lower edge as to be received within a corresponding one of said recessed areas for pivotal assembly of said side and end pieces to said bottom piece; said extensions being configured to enable said side and end pieces to be pivotally moved between two positions including an erected position and a non-erected position; each said side and end pieces having, in the upper part thereof and adjacent a lateral edge thereof, cooperating means for inter-engaging said side and end pieces in said erected position, and finger actuatable means integral with one of said side or end pieces securing said side and end pieces in an erected interengagement; said finger actuatable means consisting of an elongated part formed in said one of said side or end piece; said elongated part having one end facing a projecting part of said inter-engaging means; said finger actuatable means being flexible outwardly outside the plane of said one of said side or end piece so as to be moved out of a securing position and to enable disengagement of said side and end pieces from one another.

6. A five-piece container as defined in claim 5, wherein said cooperating inter-engaging means consist of a first part integral with said one of said side piece and end piece and projecting from a lateral edge thereof; said first part having a receiving aperture therein; said cooperating inter-engaging means consisting of a second part integral with the other of said side or end piece and projecting from a lateral edge thereof; said second part having a portion adapted to be engaged in said aperture in said securing position.

7. A five-piece container as defined in claim 6, wherein said elongated part of said finger actuatable means has one end facing said first projecting part to define said securing position.

8. A five-piece container as defined in claim 5, wherein said finger actuatable means has a finger contacting portion which is reachable inside the container.

* * * * *